United States Patent [19]

Tietz et al.

[11] Patent Number: 4,662,197

[45] Date of Patent: May 5, 1987

[54] MAGNETIC LOCK

[75] Inventors: Werner Tietz; Jurgen Krühn, both of Berlin, Fed. Rep. of Germany

[73] Assignee: Zeiss Ikon Aktiengesellschaft, Fed. Rep. of Germany

[21] Appl. No.: 809,727

[22] Filed: Dec. 17, 1985

Related U.S. Application Data

[63] Continuation-in-part of Ser. No. 521,924, Aug. 10, 1983, abandoned.

[30] Foreign Application Priority Data

Aug. 18, 1982 [DE] Fed. Rep. of Germany ..... 3230633

[51] Int. Cl.[4] ..... E05B 9/10; E05B 17/04; E05B 47/00

[52] U.S. Cl. ..... 70/276; 70/380

[58] Field of Search ..... 70/276, 413, 360, 379 R, 70/379 A, 380, 375

[56] References Cited

U.S. PATENT DOCUMENTS 1,885,697 4/1932 Sullivan ..... 70/360

FOREIGN PATENT DOCUMENTS 2349760 4/1975 Fed. Rep. of Germany ..... 70/276
1588811 4/1981 United Kingdom ..... 70/276

*Primary Examiner*—Robert L. Wolfe
*Assistant Examiner*—Lloyd A. Gall
*Attorney, Agent, or Firm*—Hill, Van Santen, Steadman & Simpson

[57] ABSTRACT

A magnetic lock is provided which has a housing carrying a rotatable core with magnetic rotors and an axially displaceable lock bar which is rotationally connected to the core. A catch ring is provided with means engagable with the lock bar to drive the lock bar axially away from an initial position upon rotation of the core, and a return ring is provided with means engagable with the lock bar to drive the lock bar axially toward the initial position upon a further rotation of the core.

3 Claims, 4 Drawing Figures

MAGNETIC LOCK

BACKGROUND OF THE INVENTION

This application is a continuation-in-part of our pending application Ser. No. 521,924, filed Aug. 10, 1983, now abandoned.

1. Field of the Invention

The invention relates to a magnetic lock equipped with an axially movable lock bar and more particularly to a magnetic lock having a positive driving means for returning a lock bar to an initial position.

2. Description of the Prior Art

A magnetic lock consisting of a housing, a cylindrical core rotatable in the housing and carrying magnetic rotors, and of an axially displaceable lock bar rotationally connected to the core has been disclosed by the German Patent application OS No. 29 05 941, whereby the lock bar is provided with lock or bolt pegs and lock or bolt elements attached to it which cooperate with the magnetic rotors and which can enter into housing clearances. Additional features of this known magnetic lock are that the lock bar cooperates with a latch ring or link ring, the lock bar entering into its control clearance in the lock position and by means of which it is subjected to axial movement out of its lock position into its release position when the cylindrical core begins to rotate and that a return force acting on the lock bar is provided in the form of a compression spring by means of which the lock bar is returned into its initial position after execution of the lock actuation.

SUMMARY OF THE INVENTION

An object of the invention is to provide a magnetic lock generally of the type described above which is always reliable in terms of its function and so that possible disruptive influences in conjunction with the motion of the lock bar, produced, for example, due to contamination, influences of weather and temperature or obstructions, do not take effect. All negative influences such as could result due to an insufficiency of the spring power relative to occurring obstructions concerning the lock mechanism are thus to be prevented or to be overcome.

The resolution of this object and, thus, the underlying inventive idea consists of providing a coercive control element instead of the spring for returning the lock bar into the lock position, the coercive control element being provided with an excursion projection axially returning the lock bar into the initial depression of the catch ring.

A preferred embodiment of the invention is provided in which the return element consists of a ring exhibiting an excursion tip, the ring, residing opposite the catch or link ring, representing a complementary form relative thereto in terms of function.

BRIEF DESCRIPTION OF THE DRAWINGS

The invention is explained in greater detail with reference to the sample embodiments illustrated in FIGS. 2 and 4.

DESCRIPTION OF THE PREFERRED EMBODIMENTS

Figure 1:
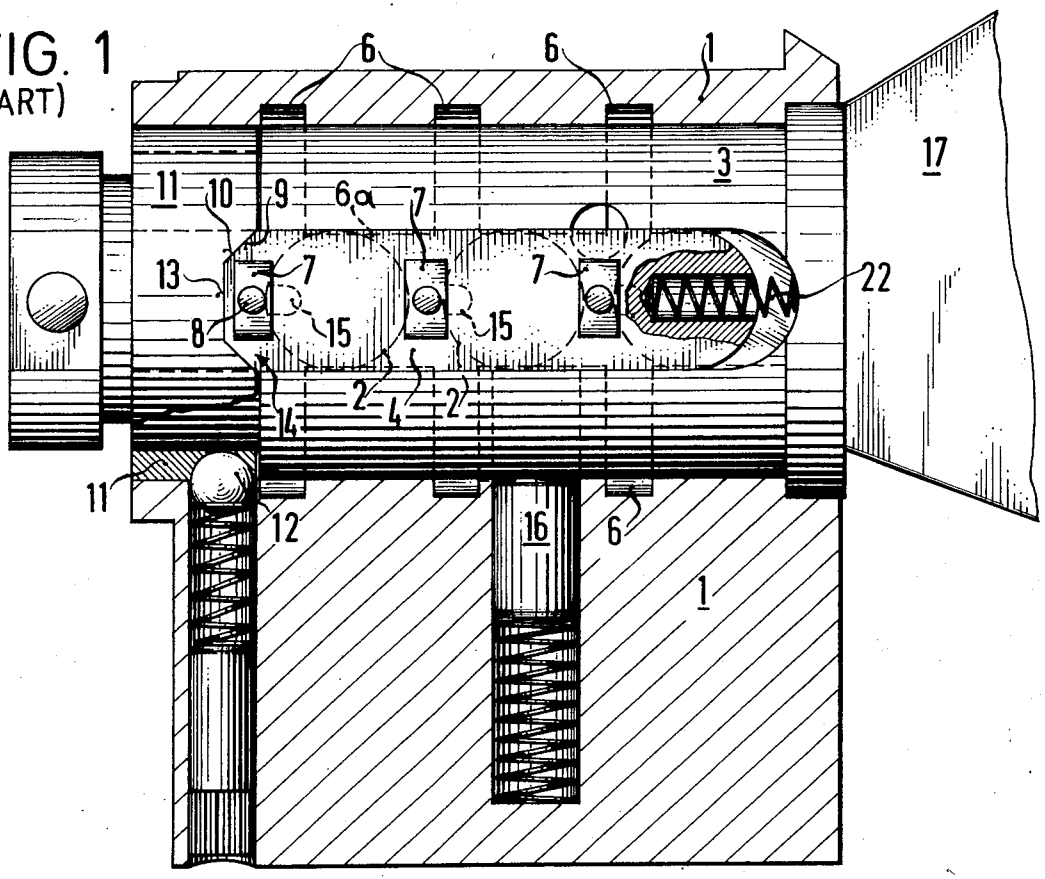
FIG. 1 (PRIOR ART)
FIG. 1 illustrates a magnetic lock representing the underlying prior art.

FIG. 1 shows a magnetic lock known in the prior art in which a cylindrical core 3 is rotatably seated in a bore of a housing 1. A key 17 having three key magnets (not shown) is inserted into the key channel of the core 3. Magnetic rotors 2 are seated in a recess of the core parallel to the key channel, said magnetic rotors 2 being brought into a defined rotational position in a known manner by the key magnets. A lock bar 4 which is displaceable in an axial direction and which is pushed inwardly toward the left as seen in FIG. 1 by the spring 22 is provided above the magnetic rotors 2 but within the recess of the core.

The lock bar 4 exhibits lock or bolt elements in the form of outer lock or bolt elements 7 and lock or bolt pegs 8 inwardly projecting into the area of the core. The lock bar 4 is equipped with a tip 14 of its left and which has obliquely converging sides 9. In the position according to FIG. 1, the tip 14 engages in an axial recess 13 of a catch ring 11. The recess 13 has sides 10 corresponding to the tip 14. The catch ring 11 is disposed around the core 3 inside the housing 1 and is rotatable both relative to the housing as well as relative to the core. The position of the catch ring according to FIG. 1 relative to the housing 1 is fixed by means of a bullet catch 12.

At the inside wall of the bore for the core, the housing 1 has a longitudinal housing groove 6*a* and annular grooves 6. The longitudinal housing groove 6*a* and the annular grooves 6 are dimensioned such that the outer lock or bolt elements 7 are displaced in an axial direction in the longitudinal housing groove and, given a corresponding position, can be rotated in the annular grooves 6 together with the rotation of the core 3.

The known lock operates as follows. When a key 17 having properly coded key magnets is inserted into the key channel, the magnetic rotors 2 assume the rotational position indicated in FIG. 1, i.e., a recess 15 of the magnetic rotors is positioned opposite the bolt peg or barring bolt 8. By means of rotating the core 3 with the key 17, the lock bar 4 is displaced outwardly toward the right against the force of a spring 22 as a result of the side 9 running up onto the side 10 of the catch ring 11. The barring bolts 8 thereby enter into the recesses 15 of the magnetic rotors. Due to the axial displacement of the lock bar 4, the outer lock elements 7 assume such positions that they fit into and align with the annular grooves 6 and the core 3 can be turned for the closing event.

After termination of the closing event (i.e., after a rotation of 360°) the lock bar 4 again engages in the recess 13 of the catch ring 11 under the force of the spring 22 and the key can be withdrawn.

When an attempt is made to actuate the control device with the wrong key, i.e., the key magnets bear the wrong coding, then the lock bar 4 cannot be displaced toward the right upon rotation of the core 3. As a result thereof, the torque is transmitted from the key 17 over the tip 14 to the catch ring 11 which, after exertion of a certain force, overcomes the retaining force of the bullet catch 12 and is subsequently corotated together with the core 3. After a brief rotation of the core, the outer lock elements strike the edge of the longitudinal housing groove *6a*. whereby further rotation of the core and, thus, locking or, respectively, unlocking with the wrong or counterfeit key is prevented.

For reasons of better illustration, the locking structure in the above-described sample embodiment has been shown on only one-half of the control device. It can, however, also be advantageous to dispose the described structure at both sides of the key, whereby the plurality of possible variations and the strength of the lock are increased. In the latter case, the catch ring 11 must exhibit two diamterically opposite recesses 13.

A pin tumbler 16 is schematically illustrated in FIG. 1. The plurality of possible variations can be significantly increased by means of the additional provision of pin tumblers.

Figure 2:
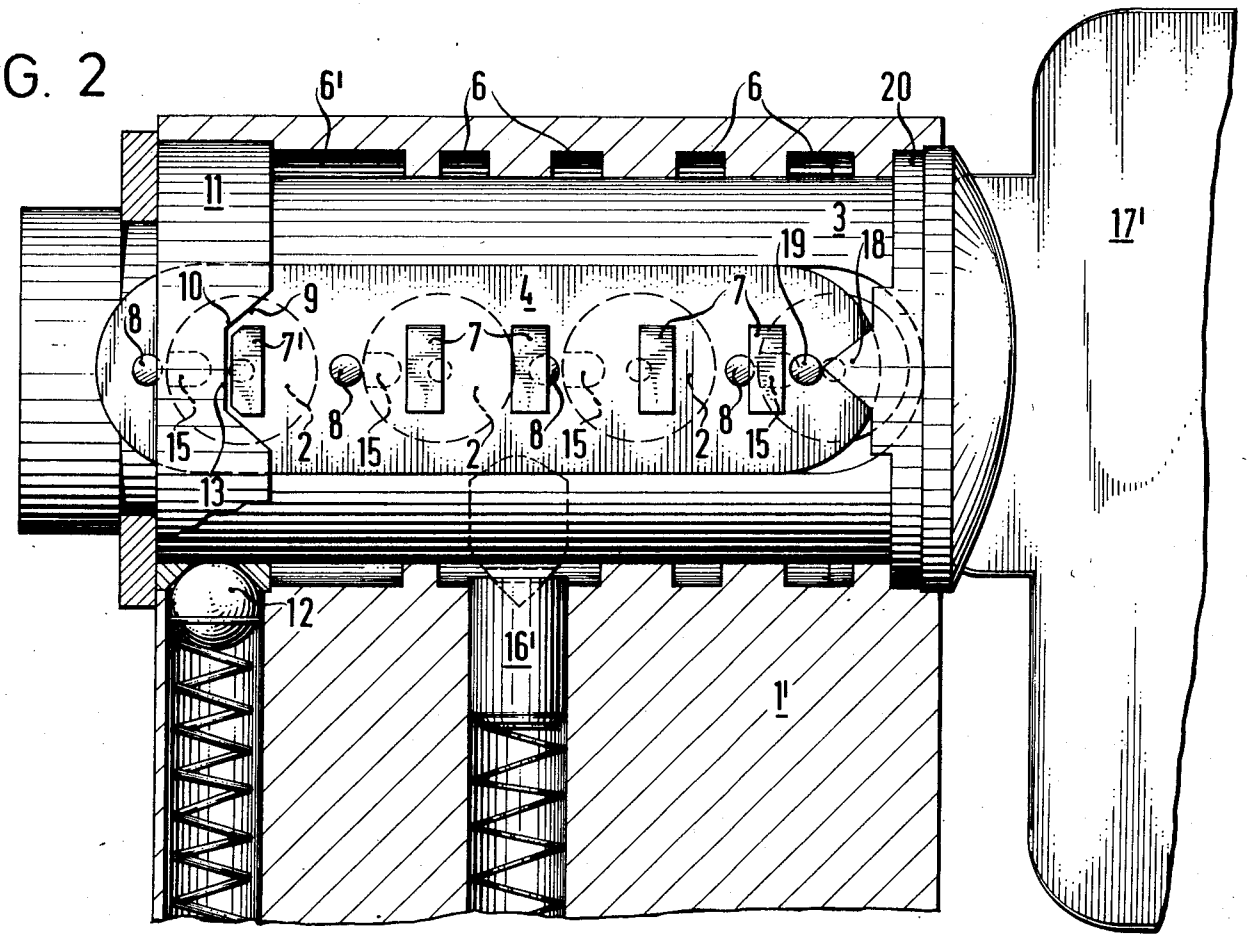
FIG. 2 is a side sectional view of the interior of a lock embodying the principles of the present invention with the cylinder shown in elevation.

The inventive solution illustrated in FIG. 2 differs from the known arrangement on the basis of the incorporation of a return ring 20 provided with a control tip 18 positioned at the circumference of the ring, ring 20 having replaced the compression spring 22 as the return element. The control tip 18 cooperates with a projecting peg 19 of the lock bar 4. The lock bar is provided with lock elements 7 and lock pegs 8 of which the lock elements 7 run in the annular housing grooves 6 given an axially deflected lock bar in the release position and the lock pegs 8 can be moved into the entry openings 15 of the magnetic rotors 2 rotated into the release position. The left end of the lock bar 4 has a lock element 7' shaped and arranged to ride on surface 10 in a camming manner upon rotation of the core 3. A mechanical tumbler pair whose core pin cooperates with a coordination notch of the key is referenced 16.

The manner of functioning of the lock arrangement of FIG. 2 proceeds as follows. After introduction of a key whose magnets exhibit the expected coding values (alignment of the field vectors), the lock rotors 2 assume such a position that the entry openings 15 are aligned opposite the lock pegs 8 of the lock bar 4 such that the pegs 8 can be inserted into the openings 15. Upon the initial rotation of the cylindrical core 3 effected by means of rotation of the key 17, the lock element 7' of the lock bar 4, which is seated against the cylindrical core 3, rides on the catch ring 11 and is caused to move toward the right to such a degree that, after entry of the lock pegs 8 into the recesses 15 of the rotors 2, the lock elements 7 align with the annular grooves 6 of the housing 1 and can enter into said annular grooves given further rotation of the cylindrical core. After rotation of approximately 360°, the control tip 18 of the ring 20 takes effect. The peg 19 of the lock bar 4 runs up onto the tip 18 in a camming action with the result that the lock bar 4 is displaced toward the left to such degree that its lock element 7' next to the catch ring enters into its initial position. This is always guaranteed by means of the positive and induced control of the lock bar. The return force is supplied by the turning of the key rather than by spring force which may at times be insufficient due to obstructions such as dirt or humidity or other weather related problems.

FIG. 2 shows the position of the parts after introduction of the fitting magnetic key 17 without a key rotation.

Figure 3:
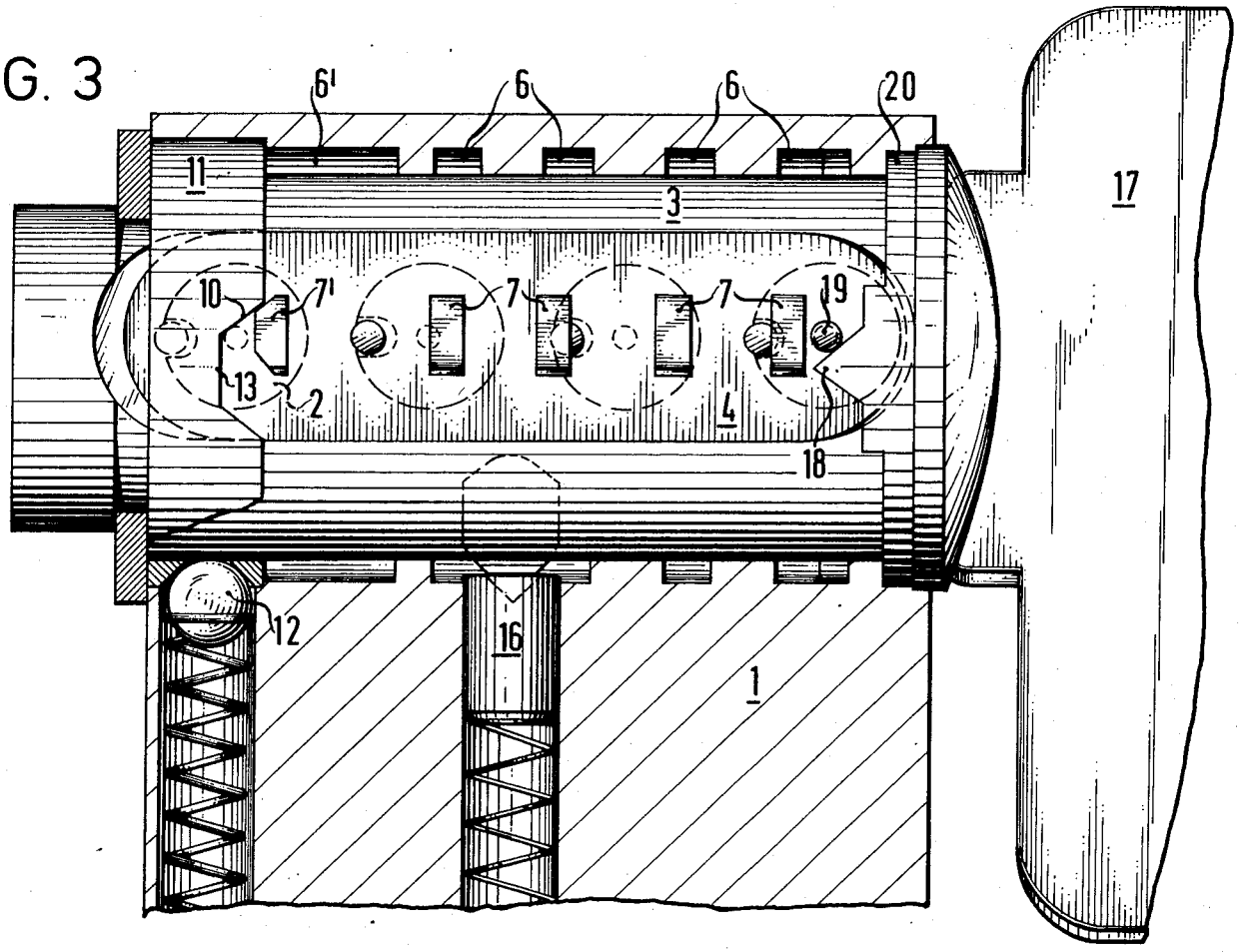
FIG. 3 is a side sectional view similar to that in FIG. 2 with the key and a portion of the lock mechanism slightly rotated.

FIG. 3 shows the conditions after beginning rotation. As a result of a clockwise rotation of the key 17, the lock bar 4 has axially moved toward the right, with the result that the lock element 7' cooperating with the catch ring 11 has run up on the one side 10 of the catch ring by means of a camming action. Upon further rotation, the peg 19 which is shown to press against the upper slant of the tip, will come around and engage the inner slant and will proceed to the tip which will result in the return of the lock bar 4 into its initial position.

Figure 4:
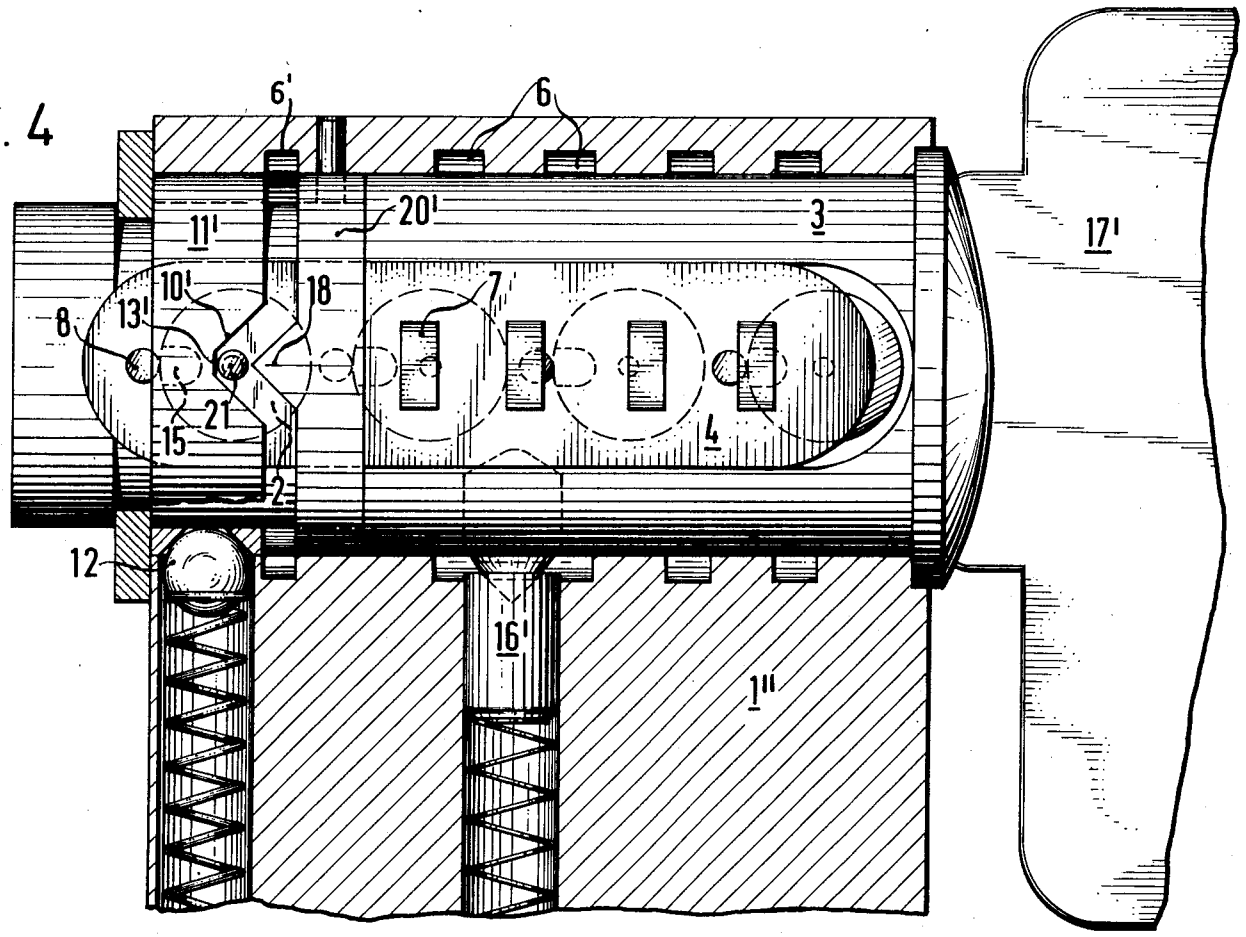
FIG. 4 is a side sectional view of an alternative embodiment of a lock embodying the principles of the present invention.

FIG. 4 shows an alternative embodiment of the invention wherein, differing from FIGS. 2 and 3, the return ring 20 is not positioned adjacent the side where the key enters but, rather is positioned adjacent the opposite side, next to the catch ring 11. Flowing from this arrangement, as can be seen in FIG. 4, is the additional advantage regarding the excursion control by the catch ring 11' as well as the return control by the ring 20' of being able to make use of a single peg 21 as the cooperating element of the lock bar 4 combining the camming functions of peg 19 and lock element 7' while retaining lock element function.

The embodiment shown in FIG. 4 provides for the peg 21 to move through the annular cam track between the catch ring 11' and the return ring 20'. Thus, a single portion of the lock bar is engaged in the camming action. This allows for a somewhat simpler construction, and also ensures positive axial control over the position of the lock bar 4.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In a magnetic lock having a housing with a cylindrical bore therethrough, a cylindrical core rotatable in said bore and an axially displaceable lock bar carried in an axial slot in said core to rotate with said core, said lock bar having at least one outwardly extending lock element, means cooperating with said lock bar causing said lock bar to move axially from an initial position upon rotation of said core including means for returning said lock bar to said initial position upon further rotation of said core, comprising:

a catch ring with a camming surface positioned at a circumference thereof, said catch ring being releasably held stationary relative to said housing by a bullet catch, and a radial projection on said lock bar being shaped and arranged to ride on said camming surface upon rotation of said core; and a return ring having an axially extending cam tip positioned at a circumference thereof, said return ring being held in a fixed position relative to said housing, and a radial projection on said lock bar engagable with said cam tip upon rotation of said lock bar and core within said housing;

said radial projection rideable on said camming surface comprising said radial projection engagable with said cam tip and further comprising a lock element;

whereby said lock bar is positively driven into and from said initial position upon rotation of said core.

2. In a magnetic lock having a housing with a cylindrical bore therethrough, a cylindrical core rotatable in said bore and an axially displaceable lock bar carried in an axial slot in said core to corotate with said core, said lock bar having at least one outwardly extending lock element, means cooperating with said lock bar causing said lock bar to move axially from an initial position upon rotation of said core including means for returning said lock bar to said initial position upon further rotation of said core, comprising:

a catch ring with a camming surface positioned at a circumference thereof, said catch ring being releasably held stationary relative to said housing by a bullet catch, and a radial projection on said lock bar being shaped and arranged to ride on said camming surface upon rotation of said core, to drive said lock bar axially away from said initial position upon rotation of said core; and a return ring having an axially extending cam tip positioned at a circumference thereof, said return ring being held in a fixed position relative to said housing, and a radial projection on said lock bar engagable with said cam tip upon rotation of said lock bar and core within said housing, to drive said lock bar axially toward said initial positon upon rotation of said core;

said radial projection rideable on said camming surface comprising said radial projection engagable with said cam tip and further comprising a lock element.

3. A magnetic lock comprising:

a housing having an axial bore therethrough with at least one annular groove in an inner wall of said bore and one longitudinal groove;

a cylindrical core rotatable about an axis in said housing bore;

said core rotatably carrying at least one magnetic rotor, said rotor having a recess in one side thereof;

an axially displaceable lock bar carried in an axial slot in said core to corotate with said core;

said lock bar being provided with at least one inwardly extending lock peg and at least one outwardly extending lock element;

said lock peg engagable with said rotor recess upon proper rotation of said rotor and axial displacement of said lock bar;

said lock element extending into said longitudinal groove when said lock bar is in an initial position and alignable with said annular groove when said lock bar is axially displaced;

means cooperating with said lock bar causing said lock bar to move axially from an initial position upon rotation of said core, comprising a catch ring with a camming surface positioned at a circumference thereof, said catch ring being releasably held stationary relative to said housing by a bullet catch, and a radial projection on said lock bar being shaped and arranged to ride on said camming surface upon rotation of said core;

means for returning said lock bar to said initial position upon further rotation of said core, said return means comprising a return ring having an axially extending cam tip positioned at a circumference thereof, said return ring being held in a fixed position relative to said housing, and a radial projection on said lock bar engagable with said camp tip upon rotation of said lock bar and core within said housing;

said radial projection rideable on said camming surface comprising said radial projection engagable with said cam tip and further comprising a lock element;

whereby said lock bar is positively driven into and from said initial position upon rotation of said core.

* * * * *